United States Patent [19]

Browning et al.

[11] 4,143,875

[45] Mar. 13, 1979

[54] GAME WITH PIVOTING MEMBER AND COORDINATED CIRCUITOUS PATHS

[76] Inventors: Walter P. Browning, 377 Avon Rd., Devon, Pa. 19333; William L. Dodge, 526 Panmure Rd., Haverford, Pa. 19041

[21] Appl. No.: 758,320

[22] Filed: Jan. 10, 1977

[51] Int. Cl.[2] ..... A63F 7/04

[52] U.S. Cl. ..... 273/101; 273/109; 273/110

[58] Field of Search ..... 273/110, 109, 120 R, 273/95 R, 101, 153 R; 46/43

[56] References Cited

U.S. PATENT DOCUMENTS

| | | | |
|---|---|---|---|
| 1,364,632 | 1/1921 | Harrington | 273/110 |
| 1,657,163 | 1/1928 | Howe | 273/110 |
| 2,003,370 | 6/1935 | Kimball | 273/110 |
| 2,746,757 | 5/1956 | Frost | 273/95 R |
| 3,720,412 | 3/1973 | Ramirez | 273/110 |

*Primary Examiner*—Richard C. Pinkham
*Assistant Examiner*—Lawrence E. Anderson
*Attorney, Agent, or Firm*—George E. Kersey

[57] ABSTRACT

Game assemblages in which a rotatable and translatable platform is manipulated with respect to an underlying base to provide an operator-controllable course for the movement of playing objects, such as spheroids, through a series of obstacles which are located in part on the platform and in part on the base.

18 Claims, 6 Drawing Figures

GAME WITH PIVOTING MEMBER AND COORDINATED CIRCUITOUS PATHS

BACKGROUND OF THE INVENTION

This invention relates to game assemblages and more particularly to labyrinth or maze game assemblages in which a playing object is movable through passageways by player manipulation.

Labyrinth or maze games usually have a platform with a series of variously connected passageways. The platform can be tilted to provide control over the movement of the playing object over a desired course from a starting position to a finishing position.

While conventional labyrinth games initially provide varying degrees of challenge, once the players have acquired sufficient experience, their interest in the game generally wanes.

Accordingly, it is an object of the invention to provide a game assemblage which can provide a high degree of sustained player interest. A related object is to achieve a game assemblage in which a high degree of skill is required even after a player has become experienced with the game. Another related object is to provide a labyrinth game assemblage which provides sustained player interest and continued challenge.

A further object of the invention is to provide a game assemblage which can be used by players of limited skill and experience, and yet affords challenge to relatively more experienced players. A related object is to provide a labyrinth game assemblage which has appeal for players having a wide range of skill and experience.

One characteristic of labyrinth games is that the playing object can sometimes become trapped at an intermediate position. In such a case it can be difficult to retrieve the playing object and reposition it at a desired starting location.

Accordingly it is a further object of the invention to provide a game assemblage for use with rolling objects in which the occurence of an intermediate fault provides no difficulty in returning the playing object to its starting position. A related object of the invention is to provide a labyrinth game assemblage type in which the playing object is readily returned to its starting position once a fault has occurred or the game has been interrupted.

Another characteristic of labyrinth game assemblages is that the passageways for the movement of the playing object are confined to a plane. This limits the skill and flexibility needed in playing the game.

Accordingly still another object of the invention is to achieve a labyrinth game assemblage in which the playing object can depart from the playing plane and play can take place at various non-planar levels.

Still another characteristic of ordinary labyrinth game assemblages is that each hand of the player can provide a limited degree of playing freedom. Thus two degrees of rotational freedom require the use of a different hand for each degree of freedom.

Consequently another object of the invention is to increase the degrees of playing freedom for a labyrinth game assemblage in order to increase the required skill and challenge.

SUMMARY OF THE INVENTION

In accomplishing the foregoing and related objects, the invention provides a game assemblage in which two members are movable relative to one another for the controlled movement of a playing object. In accordance with one aspect of the invention the playing object is movable successively from one member to another during the course of play. In accordance with another aspect of the invention one of the members is movable with two degrees of freedom along a single axis.

In accordance with a further aspect of the invention the movable member is in the form of a platform that is axially mounted in a frame, with the platform providing a set of interruptable passages for a playing object. The passages can be completed by manipulation of the platform relative to the frame. In accordance with another aspect of the invention the platform includes a set of structural elements which form segments of a desired course for the movement of a playing object from a starting position to a finishing position, while the frame includes a base with a further set of structural elements that are interspersed with those on the platform to permit completion of the course by proper manipulation of the platform.

As a result, a player can maneuver the platform to bring the structural members of the platform into proper alignment with structural members of the base and provide a continuous passage, including channels and jumps, for the movement of the playing object from a starting position to a finishing position.

In accordance with yet another aspect of the invention the base is configured so that accidental or deliberate dislodgment of the playing object from the platform results in automatic return of the playing object to its starting position.

In accordance with a further aspect of the invention the game assemblage provides for the catpulting of a playing object from one member to another. As a result the course can include regions of discontinuity in which the course can only be completed by propelling the playing object from one surface to another. This is by contrast with labyrinth games in which the playing objects are confined to surface contact.

In accordance with still another aspect of the invention the platform is not only rotatable with respect to the base but is translatable as well. The rotation permits the level of the platform to be adjusted to the desired level for transition to the passageways of elements on the base. The translation that can be imparted to the platform permits longitudinal alignment of structural members on the platform with those of the base. In addition the movability of the platform permits tapping to propel the playing object. This rotational or longitudinal tapping permits propulsion of the playing object over an obstacle, to a different level, or from one member to another.

In accordance with yet another aspect of the invention the structural elements of the platform can be interspersed with those of the base so that simultaneous rotational and translational movement of the platform can be required at various stages of play.

In accordance with a further aspect of the invention the platform can be removable from the base, and the structural elements of both the platform and the base can be changed. This permits an interchange of platforms and structural elements so that further challenge can be provided after the players have acquired a high degree of experience with a particular assemblage.

DESCRIPTION OF THE DRAWINGS

Other aspects of the invention will become apparent after considering several illustrative embodiments taken in conjunction with the drawings in which.

DETAILED DESCRIPTION

Figure 1:
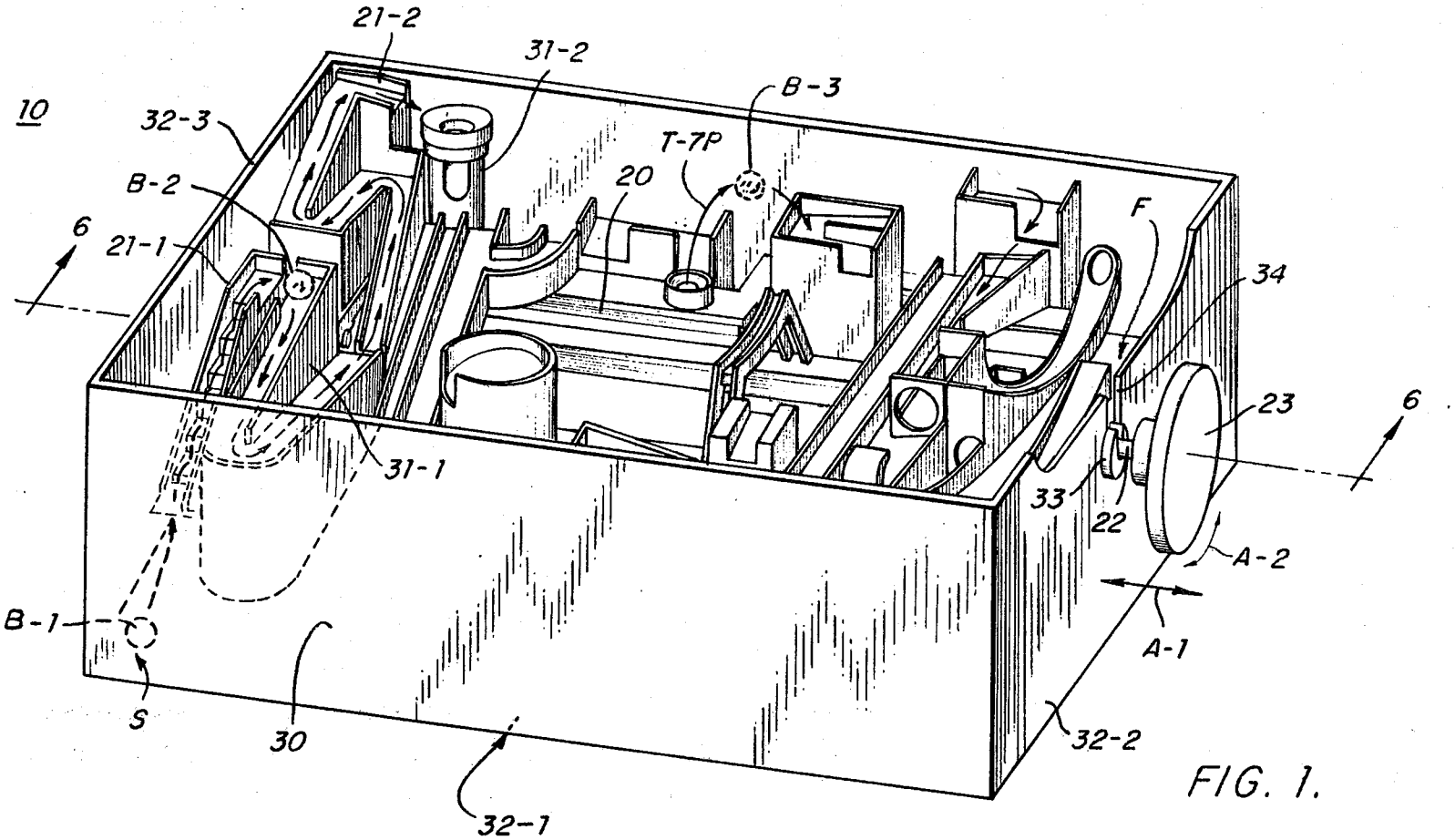
FIG. 1 is a perspective view of an overall game assemblage in accordance with the invention.

Turning to the drawings, the game assemblage 10 of FIG. 1 provides an operator controllable labyrinth or maze which can be manipulated to bring about the movement of a playing object, such as a ball B-1, B-2 or B-3, over successive portions of a course or passageway from a starting position S to a finishing position F.

Various portions of the course are provided by structural elements on a movable platform 20, such as elements 21-1 and 21-2, that are interspersed and movable relative to other structural elements that are fixedly mounted within a frame 30, on a base 32-1, such as the elements 31-1 and 31-2.

The structural elements of the platform 20, including the elements 21-1 and 21-2, have both rotational and translational freedom relative to the frame 30. This is achieved by mounting the platform 20 on an axle 22 that is positioned in end walls 32-2 and 32-3 of the frame 30. The axle 22 is rotatable and longitudinally movable by a knob 23.

As a result, a player can position the platform 20 by moving the knob 23 towards and away from the wall 32-2 in the direction indicated by the double-headed arrow A-1. In addition the platform 20 can be tilted (rotated) by moving the knob 23 in the directions indicated by the double-headed arrow A-2.

Translation of the platform 20 along the axis of the axle 22 allows longitudinal alignment of the structural elements on the platform with the structural elements arising out of the base 32-1. This is illustrated, for example, by the transition of the ball B-2 (shown in phantom) from the platform element 21-1 to the base element 31-1. Rotation of the platform 20 can provide vertical alignment and permit a rolling transfer of a playing object from a platform element to a base element, and vice versa. In addition rotation of the platform, combined with tapping against the base can be used to advance the playing piece along the platform or catapult it to another element. Similarly, translation combined with tapping can advance a playing piece or catapult it longitudinally, as illustrated by the movement of the ball B-3 (in phantom).

Figure 2:
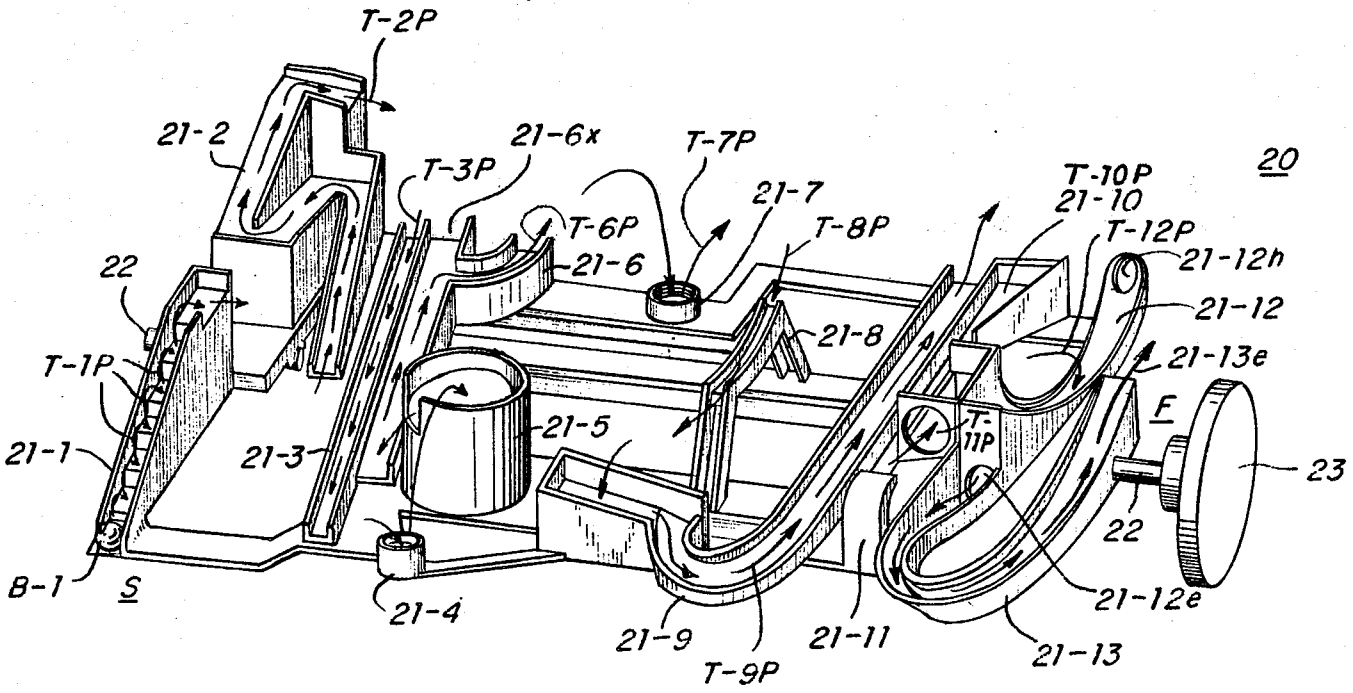
FIG. 2 is a perspective view of a movable platform for the assemblage of FIG. 1.
Figure 3:
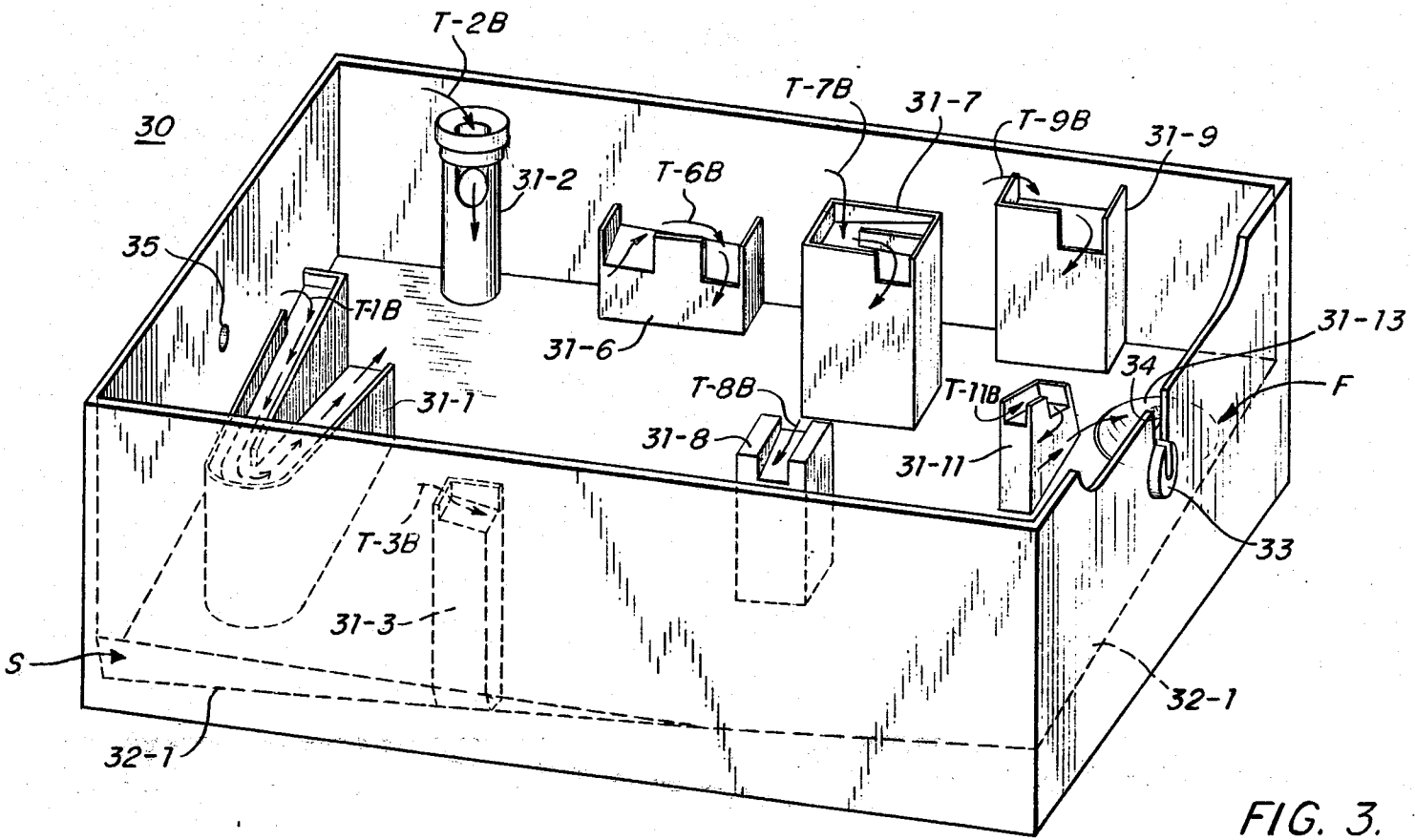
FIG. 3 is a perspective view of the frame of the assemblage of FIG. 1 into which the platform of FIG. 2 is insertable.

An illustrative movement of the playing object B-1 from the starting position S to the finishing position F is illustrated in conjunction with FIGS. 2 and 3.

FIG. 2 shows the platform 20 removed from the frame 30 of FIG. 1, with the removal resulting in the frame configuration 30 of FIG. 3.

The playing object, which is a ball B-1 in FIG. 2, is initially positioned at the base of the staircase element 21-1. The ball B-1 is advanced up the staircase along the trajectory T-1P by tapping the platform 20, when positioned in the frame 30, against the base 32-1 (shown in FIG. 3).

Once the ball B-1 reaches the top of the staircase 21-1 further passage along the course towards the finishing position F requires that the platform 20 be correctly oriented with respect to the adjoining slide element 31-1 of the frame 30, shown in FIG. 3.

Thus, if the staircase 21-1 is at the proper level and the ball B-1 has been given an axial component of motion, it makes a transition to the slide 31-1 along the trajectory T-1B.

At the base of the slide 31-1, the ball B-1 can make a transition to the ramp element 21-2 if the platform 20 has been correctly oriented by the player using the control knob 23. The ball is then moved along the trajectory T-2P to an exit position, where it makes a transition to the opening in the top of a tower 32-2, moving along a trajectory T-2B.

After passing through the tower 32-2, the ball can move along the inclined element 21-3 with a trajectory T-3P if the platform 20 is properly positioned.

From the base of the incline 21-3, with the platform 20 rotated in a clockwise direction, the ball can roll into a side trough 31-3 on a trajectory T-3B, and out of the trough 31-3 into a small cup 21-4.

Once in the cup 21-4, the ball can be catapulted along a trajectory T-4P into the large cup 21-5, exiting into a channel 21-6 along a trajectory T-6P into an opposing wall trough 31-6. If the play is improper, the ball will instead go off the end of the channel 21-6 (and thus off the platform 20) at position 21-6X.

In the trough 31-6, the ball moves along a trajectory T-6B into a second small cup 21-7. The next movement in advancing the ball towards the finishing position F, is a translational tapping of the platform 20 against the end wall 32-2 to propel the ball through the air along a trajectory T-7P into a twin tower 31-7.

The ball moves through the tower 31-7 along a trajectory T-7B. If the platform 2 is properly aligned, the ball rolls onto a bridge 21-8, with a trajectory T-7P, into a further trough 31-8.

Upon leaving the trough 31-8, the ball enters a U-channel 21-9 on a trajectory T-9P, exiting into a tower 31-9, if the player has properly positioned the platform 20.

From the tower 31-9, the ball can be rolled into a channel 21-10 and then along a ramp to a switchback 21-11 on trajectories T-10P and T-11P. If the platform 20 is correctly positioned, the motion of the ball carries it to a tower 31-11 on a trajectory T-11B. Upon leaving the tower 31-11, the ball can enter a channel 21-12 on a trajectory T-12P.

If the platform 20 is not correctly positioned, the ball will fall through the hole **21-12*h*. Otherwise it will pass through an opening 21-12*e* into a curved channel 21-13 and off an end 21-13*e*, striking a bell 31-13** or other suitable indicator that the play has been successfully brought to the finishing position F.

As noted above, if the player does not correction manipulate the platform 20 with respect to the frame 30 during play, the ball will tumble from one of the structural elements onto the base 32-1.

The invention provides for the automatic retrieval of a ball that has fallen from a playing position by having a slope in the base 32-1, with its lowest level at the starting position S. As a result, a ball that has fallen from the desired course will automatically roll to the starting point.

Figure 4:
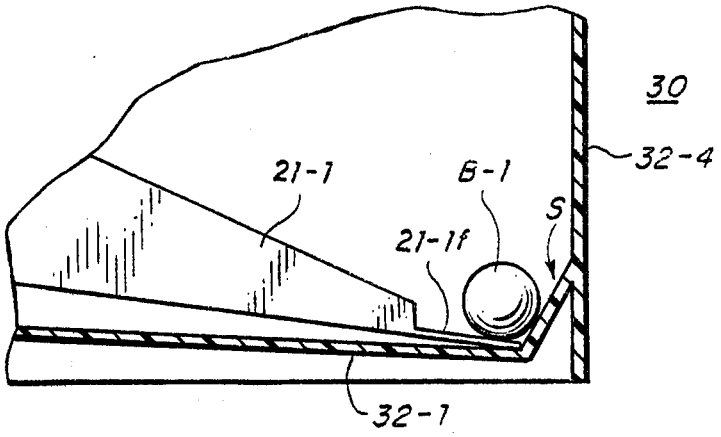
FIG. 4 is a sectional view of a portion of the assemblage of FIG. 1 showing a pickup member in accordance with the invention.

The ball is then readily put in playing position by use of the pick-up finger 21-1*f* which is included at the base of the staircase element 21-1 as shown in FIG. 4. The pick-up is accomplished by reciprocating the platform 20 towards the front wall 32-2 and then sliding the finger towards the back wall 32-3 while making contact with the base 32-1. The ball B-1 is, in effect, scooped into position for the start of play.

Figure 5:
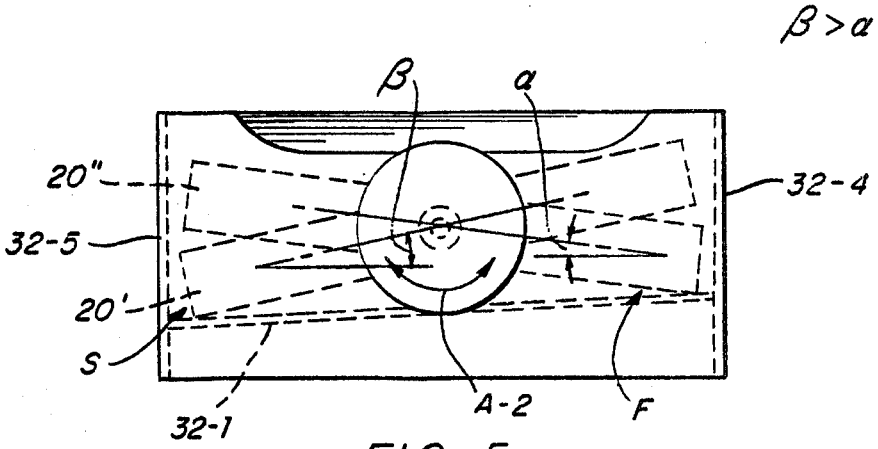
FIG. 5 is a schematic representation showing the rotational motion which can be imparted to the platform of FIG. 2 by a player.
Figure 6:
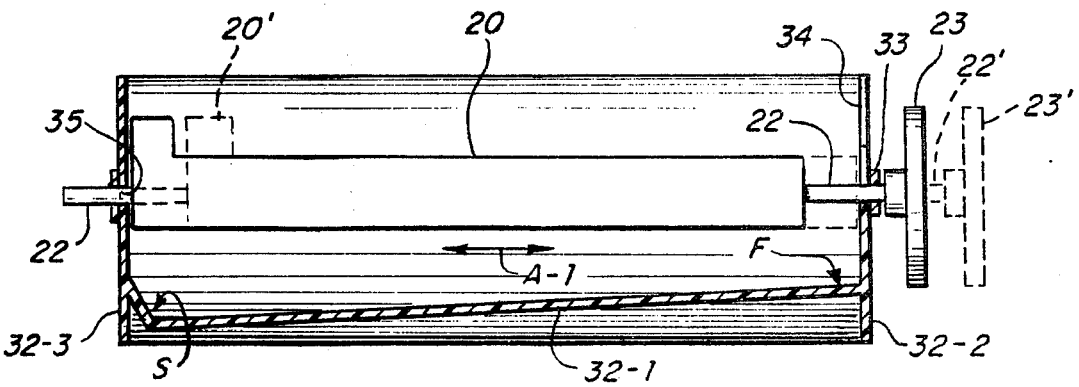
FIG. 6 is an illustrative sectional view illustrating the translational motion that can be imparted to the platform of FIG. 2 by a player during the course of advancing a playing object from a starting position to a finishing position.

Other structural features of the game assemblage are illustrated in FIGS. 5 and 6. As indicated in FIG. 5, the angles $\alpha$ and $\beta$ with respect to the horizontal are different for the platform in the clockwise and counterclockwise directions A-2 of play. This allows a different degree of tapping for each different direction of rotation. Where desired, the degree of tapping can be made the same for both directions of rotation by suitable placement of axle of the platform in the frame.

The translational movement of the platform 20 with respect to the frame is illustrated in FIG. 6. When the knob 23 is pulled outwardly from the front wall 32-2 to the phantom position 23', the platform 20 is at the phantom position 20' in the vicinity of the inner surface of the wall 32-2.

FIG. 6, taken in conjunction with FIG. 3 also illustrates the placement of the platform 20 in the frame 30. For that purpose, the frame has an aperture 35 in the rear wall 32-2 and a slot 34 in the front wall 32-2. The platform 20 is placed in position by insertion of the end of the axle 22 into the aperture 35 and moving the end of the axle near the knob 23 in the slot 34 until the axle is in position. In order to retain the axle in position, while permitting rotation and translation, a flexible bushing 33 in the form of a locking bearing is desirably employed. The bushing 33 is advantageously of a plastic resin, such as polyethylene. Low friction materials such as bronze may also be employed.

By virture of the slot 34, the platform 20 can be removed and replaced with another platform having different structural elements. In addition the structural elements of the frame may also be replaceable to permit variation of the course over which the playing object is moved.

The platform and frame are desirably molded from a thermoplastic material, such as an acrylic resin, which has suitable rigidity, to permit tapping, but is not so brittle that tapping will produce fractures. Because of the significant amount of movement to which the axle 22 is subjected, it is desirably of a durable material, such as a polycarbonate resin. The axle may be molded as an integral part of the platform, or separately.

While various aspects of the invention have been set forth by the drawings and specification, it is to be understood that the foregoing detailed description is for illustration only and that various changes in parts, as well as the substituation of equivalent constituents for those shown and described may be made without departing from the spirit and scope of the invention as set forth in the appended claims.

What is claimed is:

1. A game assemblage comprising a playing object; a first member including a first partial, discontinuous circuitous path containing a first plurality of non-linear obstacle elements at various nonplanar levels; a second member pivotable relative to said first member and including a second partial, discontinuous, circuitous path containing a second plurality of non-linear obstacle elements at various nonplanar levels; said second partial, discontinuous, circuitous path being coordinated with individual non-linear obstacle elements of said first partial circuitous path at a plurality of points so as to form a complete continuous, circuitous path and means for manipulating said second member relative to said first member to move a playing object from one of the members to the other member and back to the one member so that the playing object travels the complete, continuous, circuitous path by traveling over said obstacle elements.

2. A game assemblage as defined in claim 1 further including means for catapulting said playing object from one of said members.

3. A game assemblage as defined in claim 1 wherein said second member is rotatable relative to said first member.

4. A game assemblage as defined in claim 1 wherein said second member is translatable relative to said first member.

5. A game assemblage as defined in claim 1 wherein said second member includes structural elements which are interspersed with structural elements of said first member.

6. A game assemblage as defined in claim 1 wherein said second member is removable from said first member.

7. A game assemblage as defined in claim 1 wherein said first member includes a base which has a slope relative to said second member.

8. A game assemblage as defined in claim 1 wherein said second member includes means on said second member for retrieving said playing object from said first member.

9. A game assemblage as defined in claim 1 wherein said second member is rotatable from a normal position in both clockwise and counterclockwise directions relative to said first member and the angles of rotation are unequal.

10. A game assemblage as defined in claim 1 wherein said second member is tappable against said first member for advancing said playing object from one of said members.

11. A game assemblage comprising a playing object; a first member having a first partial, discontinuous, circuitous path containing a first plurality of obstacle elements at nonplanar levels; and a second member having an axis and being axially movable relative to said first member and having a second partial, discontinuous, circuitous path containing a second plurality of obstacle elements at nonplanar levels; said second, partial, discontinuous, circuitous, path being coordinated with said first partial, discontinuous, circuitous path at a plurality of points so as to form a complete, continuous, circuitous path said second member having both rotational and translational degrees of freedom relative to said axis for controlling the movement of a playing object from one of said partial, discontinuous, circuitous paths and back as the playing object travels the complete circuitous path by traveling over said obstacle elements.

12. A game assemblage as defined in claim 11 further including means for catapulting said playing object from one of said members.

13. A game assemblage as defined in claim 11 wherein said second member includes structural elements which are interspersed with structural elements of said first member.

14. A game assemblage as defined in claim 11 wherein said second member is removable from said first member.

15. A game assemblage as defined in claim 11 wherein said first member includes a base which has a slope relative to said second member.

16. A game assemblage as defined in claim 11 wherein said second member includes means on said second member for retrieving said playing object from said first member.

17. A game assemblage as defined in claim 11 wherein said second member is rotatable from a normal position in both clockwise and counterclockwise directions relative to said first member and the angles of rotation are unequal.

18. A game assemblage as defined in claim 11 wherein said second member is tappable against said first member for advancing said playing object from one of said members.

* * * * *